United States Patent [19]

Deasy

[11] Patent Number: 5,065,164

[45] Date of Patent: Nov. 12, 1991

[54] FREQUENCY RANGE ENCHANCED MONOPOLE ANTENNA

[75] Inventor: Richard E. Deasy, Cedar Rapids, Iowa

[73] Assignee: Rockwell International Corporation, El Segundo, Calif.

[21] Appl. No.: 390,791

[22] Filed: Aug. 8, 1989

[51] Int. Cl.[5] ..... H01Q 9/32

[52] U.S. Cl. ..... 343/749; 343/825; 343/850; 343/792.5

[58] Field of Search ..... 343/749, 750, 752, 722, 343/850, 792.5, 825

[56] References Cited

U.S. PATENT DOCUMENTS 1,676,240 9/1928 Affel ..... 343/749
1,708,515 4/1929 Meissner ..... 343/749
1,783,025 11/1930 Meissner ..... 343/749
1,967,881 7/1934 Green ..... 343/749

*Primary Examiner*—Michael C. Wimer
*Attorney, Agent, or Firm*—John J. Horn; M. Lee Murrah; H. Fredrick Hamann

[57] ABSTRACT

A monopole antenna adapted for efficiently radiating energy over an enhanced range of frequencies. The antenna includes a vertically inclined wire approaching one-quarter wavelength of said range of frequencies and a number of small-sized inductors installed along the length of said wire. The inductors are spaced apart so as to have negligible mutual coupling and are sized sufficiently small so that they do not have individual resonances over the range of frequencies for which the antenna is operational. The inductors provide a distributed reactance which allows the antenna to operate with greater efficiency over a broader range of frequencies.

3 Claims, 1 Drawing Sheet

FREQUENCY RANGE ENCHANCED MONOPOLE ANTENNA

BACKGROUND OF THE INVENTION

The present invention relates to radio antennas and more particularly to enhanced bandwidth tactical antennas which are capable of efficiently radiating energy over a broad range of frequencies.

The radio antennas which are used in modern applications such as frequency hopping systems are often required to operate over a range of frequencies. Since the monopole antennas commonly employed on tactical applications typically are electrically short (have mechanical length less then ¼ wavelength) and have a narrow bandwidth, the impedances of such antennas may easily become mismatched with their transmitters leading to serious losses in efficiency. Hence, antenna coupling systems employing tunable high voltage load coils have been developed which tune these antennas for resonance when antenna length is less than one-quarter wavelength of the operational frequency. Such coupling arrangements result in narrow band tuned conditions which must be adjusted for every change in frequency in order to assure efficient power transfer and further result in high voltage levels under conditions where mismatches do occur. Since antenna coupling systems are relatively slow in executing the retuning function, such couplers do not always provide an adequate solution to antenna tuning for applications such as frequency hopping systems.

It is therefore, an object of the present invention to provide an electrically short tactical antenna system which has inherently broad bandwidth characteristics in radiating radio frequency energy in order to simplify antenna coupling requirements.

It is a further object of the present invention to provide a broad bandwidth electrically short antenna system which lowers the voltage levels on the antenna coupling network due to impedance mismatches between the antenna and the transmitter.

It is another object of the present invention to provide an electrically short monopole antenna system which is simple and inexpensive to construct, yet has a comparatively uniform driving point impedance over a broader range of operating frequencies.

SUMMARY OF THE INVENTION

The present invention provides an extended bandwidth monopole antenna adapted for efficient power transfer between the transmitter and antenna over a broad range of frequencies. More specifically, bandwidth is enhanced for frequencies where antenna length is less than one-quarter wavelength for the operational frequency. The antenna includes a large number of small inductors (or coils) which are installed in series with the wire constituting the antenna structure. These inductors are spaced apart along the length of the antenna so as to be effectively isolated from one another and exhibit negligible mutual inductive coupling. Additionally, the inductors are sized to be small enough so as not to have any individual resonances within the operating frequency range of the antenna.

In the preferred embodiment, a greater number of the inductors are positioned toward the upper vertical or distal end of the antenna and are accordingly spaced more closely together toward this end of the antenna. Additionally, the inductors may be selected to be of progressively greater inductance value toward the upper or distal end of the antenna. In operation, the inductors provide a distributed reactive loading which enhances the bandwidth of the antenna and allows operations over a greater range of frequencies at an improved Voltage Standing Wave Ratio (VSWR).

DESCRIPTION OF THE PREFERRED EMBODIMENT

Figure 1:
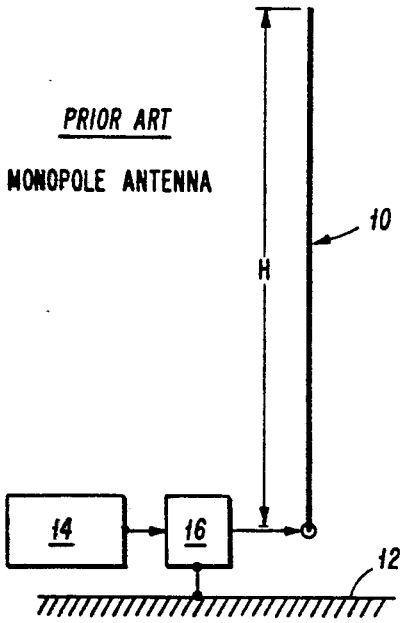
FIG. 1 shows a model for a standard monopole antenna in accordance with the prior art.

Referring now to FIG. 1, a conventional tactical monopole antenna 10 is shown. The antenna 10 consists of a conductive wire IB which is vertically inclined with reference to a ground reference plane 12. The antenna 10 is "electrically short" and dimensioned so as to have a vertical length H which is approximately one-quarter wavelength at a higher operational frequency of the transmitter 14 for which the antenna 10 is the radiating element. In general, the antenna 10 would constitute a standard "thin whip" antenna of the type capable of supporting itself in a vertically inclined position when mounted on a structure such as a vehicle. Frequently, an antenna coupler 16 including "load coil" type inductive elements will be associated with the antenna 10 for interfacing the transmitter 16 to the antenna 10 and assisting in matching the impedance exhibited by antenna 10 to the impedance of the transmitter 14 for frequencies where H is less than (or greater than) one-quarter wavelength of the operational frequency of the transmitter 14. It should be noted that at frequencies less than one-quarter wavelength where the load coil is used to resonate the antenna 10 by "tuning out" the antenna's capacitive reactance, the resulting bandwidth of the antenna 10 is relatively narrowband.

Figure 2:
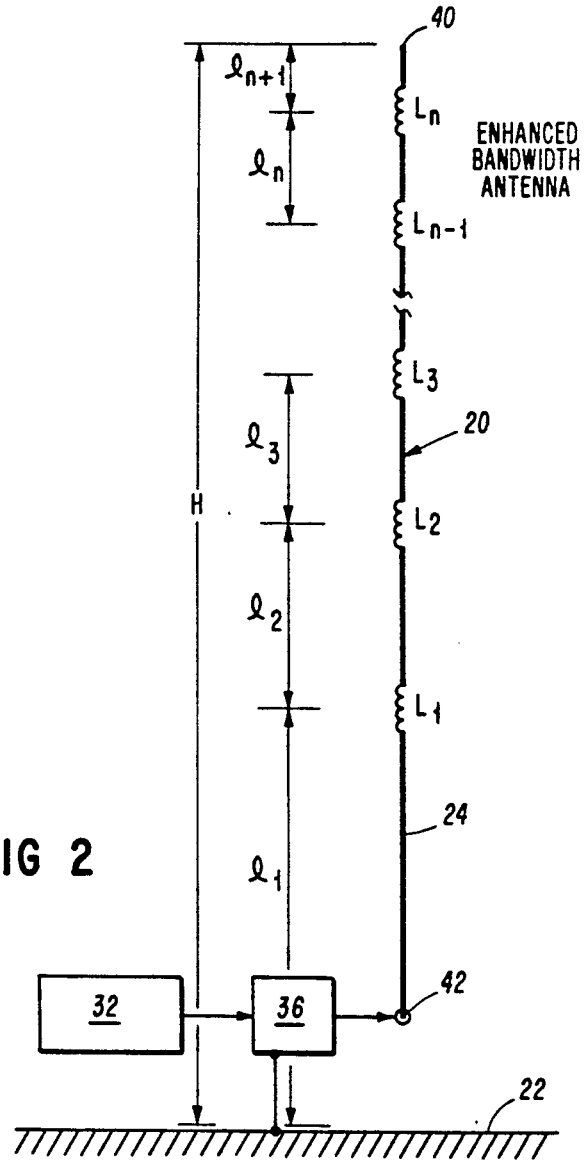
FIG. 2 shows a model for an extended bandwidth monopole antenna in accordance with the present invention.

Referring now to FIG. 2, the present invention comprises a monopole antenna 20 which is vertically inclined with respect to a ground plane 22. The antenna 20 comprises a conductive wire (or thin whip) 24 which approaches one-quarter wavelength in length H for the range of frequencies over which the antenna 20 is intended to radiate energy and is generally one-quarter wavelength in length H for the mid or highest frequencies within the operational band of the antenna 20. The antenna 20 also includes a large number of small inductors (or coils) $L_1$–$L_n$ which are installed along its length in a spaced apart pattern.

The inductors $L_1$–$L_n$ are positioned with sufficient distance between them so as to have negligible mutual inductive coupling. The inductors $L_1$–$L_n$ are therefore adequately isolated from one another and do not electrically interact except as simple series circuit elements. It should be noted, however, that the inductors $L_1$–$L_n$ will generally exhibit increased amounts of capacitive interaction with the ground plane 22 compared to the wire 24. This interaction raises the characteristic capacity of the antenna 20 and affects the reactance introduced into the antenna 20 by the inductors $L_1$–$L_n$. This change in reactance contributes to the improved performance of the present invention in increasing antenna bandwidth.

Further, the inductors $L_1$–$L_n$ are sized to be sufficiently small so that they have no individual resonances (e.g. resulting from the self-capacitances of the individual inductors) within the frequency range over which the antenna 20 is intended to operate. The small sizing of inductors $L_1$–$L_n$ prevents the electrical characteristics of the individual inductors from separately interfering with the overall operational characteristics of the antenna 20.

In a typical installation, the antenna 20 might constitute a thin whip of approximately sixteen feet (5 meters) in length mounted at its proximal end 42 on a vehicle such as a truck and which would be intended to operate over a radio frequency range from 2 MHz to 30 MHz (the military HF band). A large number of small inductors $L_1$–$L_n$ such as twenty-eight inductors would be installed along the length of the wire 24 constituting the antenna 20. The inductors $L_1$–$L_n$ would be of relatively small size each having approximately one-half (½) microHenry of inductance each and would be separated from one another by approximately six (6) inches of distance. This configuration would lower the natural resonant length of the antenna 20 from 15 MHz to near 8.5 MHz in this particular case.

The antenna system 20 may be optimized by adjusting the spacing and the size of the inductors $L_1$–$L_n$ with respect to the ends 40 and 42 of the antenna 20. It is preferred that the distances $l_1$–$l_{n+1}$ between the inductors $L_1$–$L_n$ should progressively decrease toward the distal end 40 of the antenna 20. It is believed that the best performance may be achieved when the distances $l_1$–$l_{n+1}$ decrease approximately logarithmically, although any positioning pattern in which the greater number of inductors $L_1$–$L_n$ are located toward the distal end 40 of the antenna is believed to be beneficial. It is also thought that improved performance may be achieved by having the inductance values of the inductors $L_1$–$L_n$ progressively increase in a linear fashion from the first inductor $L_1$ to the last inductor $L_n$ toward the distal end 40 of antenna 20, although any regular pattern of increase is believed it to be beneficial to the operation of the invention.

In operation, the radio transmitter 32 supplies radio frequency energy to the antenna coupler 36. The antenna coupler 36 includes load coils which help match the impedance of the transmitter output circuit to the antenna thereby resonating the antenna 20 to the frequency of the energy provided by the transmitter 32. However, this task is substantially simplified by the present invention since the antenna 20 provides a more uniform impedance over a greater range of frequencies. Consequently, the antenna coupler 36 is required to provide less inductive loading in order to resonate the antenna at the lower operating frequency range and for similar frequencies the Voltage Standing Wave Ratio characteristic of the match between the transmitter 32 and antenna 20 is substantially less.

Figure 3:
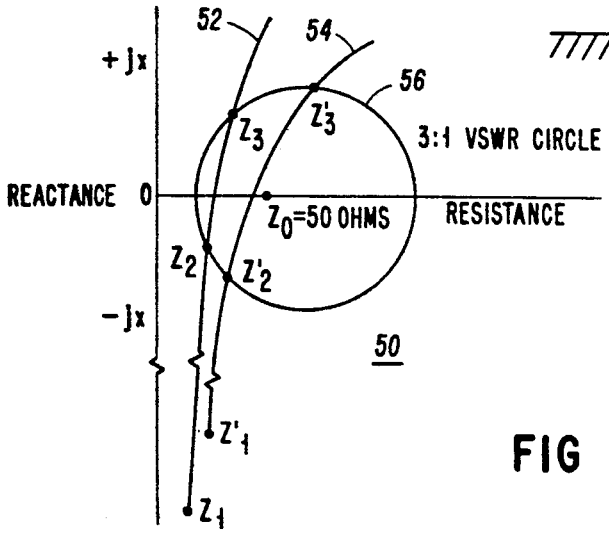
FIG. 3 provides a graph showing a pair of exemplary curves illustrating the driving point impedance of antennas constructed both in accordance with the prior art and in accordance with the present invention.

Referring now to FIG. 3, the graph 50 depicts the complex impedance plane with resistance shown across on the abscissa and reactance shown on the ordinate. The curves 52 and 54 trace the impedances of two different antennas of equal length as a function of frequency. The curve 52 represents a conventional monopole antenna of the type with which an antenna coupler including one or more large load coils would be used. The curve 54 represents an extended bandwidth monopole antenna in accordance with the present invention. It may be observed that the curve 54 covers a somewhat lower range of impedances for the same frequencies, this being especially true for the lower frequencies over which the antenna is intended to operate (near $Z_1$ and $Z'_1$). The foregoing principles are illustrated by the circle 56 delimiting the sections of the curves 52 and 54 encompassed by a Voltage Standing Wave Ratio of approximately 3.0 to 1. In particular, for impedances encompassed by the 3:1 VSWR circle 56, $Z'_2$–Z'hd 3 occur at lower frequencies than $Z_2$–$Z_3$. The usefulness of these properties should be apparent in that a lower Voltage Standing Wave Ratio is achieved for similar frequency ranges of operation and less antenna excitation voltage is therefore required. The antenna coupling system associated with antenna may therefore be simplified and the radiating efficiency of the antenna may be improved thereby allowing a greater proportion of the energy generated by the transmitter to be actually radiated by the antenna.

In the alternative, viewing the antenna 20 as a transmission line, the inductors $L_1$–$L_n$ serve to shorten the electrical length of the antenna as operational frequencies are increased thereby assisting in providing an improved radiation pattern for the antenna 20. Further, it is believed that inductors $L_1$–$L_n$ help the antenna 20 interact with the ground plane 22 so as to promote the production of a more powerful ground wave over a larger range of frequencies which is desirable for short and intermediate range communications.

While particular embodiments of the present invention have been shown and described, it should be clear that changes and modifications may be made to such embodiments without departing from the true scope and spirit of the invention. It is intended that the appended claims cover all such changes and modifications.

I claim:

1. An antenna system adapted for efficiently radiating energy over a broad range of frequencies, comprising;

an antenna coupler including one or more load coils designed for resonating a monopole type antenna;

a wire whip which is approximately one-half wavelength in length with respect to the highest frequency within said range and is approximately one-quarter wavelength in length with respect to the mid-frequency within said range and which is connected to said antenna coupler; and a plurality of inductors installed along said wire whip, said inductors positioned so as to be electrically isolated from one another by being spaced apart by several inches and progressively spaced more closely together toward the distal end of said antenna, and also sized so as to be non-resonant over said range of frequencies and of greater inductance value toward the distal end of said antenna.

2. The antenna of claim 1, wherein said wire whip is approximately 16 feet in length where said range of frequencies extends from approximately 2 MHz to approximately 30 MHz.

3. The antenna of claim 1, wherein said inductors are spaced in an approximately logarithmic distribution along the length of said antenna.

* * * * *